US005240800A

United States Patent [19]

Contois et al.

[11] Patent Number: 5,240,800

[45] Date of Patent: Aug. 31, 1993

[54] NEAR-INFRARED RADIATION SENSITIVE PHOTOELECTROGRAPHIC MASTER AND IMAGING METHOD

[75] Inventors: Lawrence E. Contois, Conesus; Dennis R. Kamp, Spencerport; William Mey, Rochester, all of N.Y.

[73] Assignee: Eastman Kodak Company, Rochester, N.Y.

[21] Appl. No.: 737,114

[22] Filed: Jul. 29, 1991

[51] Int. Cl.[5] ..... G03G 5/09; G03G 13/22

[52] U.S. Cl. ..... 430/51; 430/83; 430/126

[58] Field of Search ..... 430/31, 51, 83, 126

[56] References Cited

U.S. PATENT DOCUMENTS

| | | | |
|---|---|---|---|
| 3,451,811 | 7/1969 | Brynko | 430/70 |
| 3,554,745 | 1/1971 | Van Allan | 430/74 |
| 3,577,235 | 5/1971 | Contois | 430/74 |
| 3,615,406 | 10/1971 | Merrill | 252/501.1 |
| 3,709,683 | 1/1973 | Ciuffini et al. | 430/54 |
| 3,748,128 | 7/1973 | McNally | 430/103 |
| 3,879,197 | 4/1975 | Bartlett et al. | 430/54 |
| 3,909,254 | 9/1975 | Tamai et al. | 430/46 |
| 3,982,935 | 9/1976 | Bartlett et al. | 430/97 |
| 3,998,636 | 12/1976 | Van den Houte et al. | 430/80 |
| 4,047,945 | 9/1977 | Pfister et al. | 430/57 |
| 4,124,286 | 11/1978 | Barasch | 355/40 |
| 4,283,475 | 8/1981 | Kawamura et al. | 430/83 X |
| 4,421,837 | 12/1983 | Hiroshi | 430/31 |
| 4,468,444 | 8/1984 | Contois | 430/72 |
| 4,661,429 | 4/1987 | Molaire et al. | 430/70 |
| 4,663,260 | 5/1987 | Kitatani et al. | 430/83 |
| 4,681,827 | 7/1987 | Franke et al. | 430/83 |
| 4,818,660 | 4/1989 | Blanchet-Fincher et al. | 430/281 |
| 4,859,551 | 8/1989 | Kempf | 430/49 |

FOREIGN PATENT DOCUMENTS

| | | | |
|---|---|---|---|
| 0109842 | 5/1984 | European Pat. Off. . | |
| 0244780 | 11/1987 | European Pat. Off. . | |
| 8149 | 1/1981 | Japan | 430/83 |
| 146059 | 8/1984 | Japan | 430/51 |
| 7800123 | 4/1978 | Netherlands . | |
| 1380737 | 1/1975 | United Kingdom . | |
| 92/1158 | 7/1992 | World Int. Prop. O. . | |

OTHER PUBLICATIONS

Research Disclosure 12846 "Method and Apparatus for the Production of Multiple Prints from Reusable Conductivity Photoconductor Element", Dec., 1974.

Schein, "Electrophotogaphy and Development Physics", Chpt. 2, pp. 26–32 (1988).

*Primary Examiner*—Roland Martin

*Attorney, Agent, or Firm*—Nixon, Hargrave, Devans and Doyle

[57] ABSTRACT

A photoelectrographic element for electrostatic imaging, containing a conductive layer and a photosensitive layer, is produced using photosensitive layer materials which form a barrier to charge injection where exposed to near-infrared radiation. As a result, exposed areas can be charged, while unexposed portions cannot. The photosensitive layer contains an organic photoconductor, a near-infrared radiation sensitizer, and, optionally, an organic binder. A method of forming images with this phctoelectrographic element is also disclosed.

18 Claims, 1 Drawing Sheet

NEAR-INFRARED RADIATION SENSITIVE PHOTOELECTROGRAPHIC MASTER AND IMAGING METHOD

FIELD OF THE INVENTION

The present invention relates to a near-infrared radiation sensitive photoelectrographic master.

BACKGROUND OF THE INVENTION

Electrophotographic compositions and imaging processes are well known. In these processes, an electrophotographic element having a layer containing a photoconductor is electrostatically charged and then imagewise exposed to form a latent electrostatic image. The latent electrostatic image is subsequently developed with a toner composition. Electrophotographic elements and processes are disclosed, for example, in U.S. Pat. Nos. 3,141,770 to Davis et al., 3,554,745 to Van Allen, 3,577,235 to Contois, 3,615,414 to Light et al., 4,442,193 to Chen et al., 4,421,837 to Hiroshi et al., and 4,468,444 to Contois. Unfortunately, with any electrophotographic element, it is always necessary to charge electrostatically and imagewise expose the charged element for each copy being made.

Multiple copies have been made from a single exposure using photoelectrographic elements in which a persistent differential conductivity pattern is created between exposed and unexposed portions. This allows for subsequent use of the element in printing multiple copies from a single exposure with only multiple charging, developing, transferring, and cleaning steps. This is different from electrophotographic imaging techniques where the electrophotographic element must generally be charged electrostatically followed by imagewise exposure for each copy produced.

Photoelectrographic masters are ideal for use in xeroprinting or multiple color proofing, because multiple high-quality prints can be produced rapidly in view of the need for only a single exposure. This is especially useful in making color images.

One type of master, disclosed in U.S. Pat. No. 4,818,660 to Blauchet-Fincher et al. and U.S. Pat. No. 4,859,551 to Kempf, is prepared by coating a photohardenable layer on an electrically conductive substrate and exposing the layer imagewise to light. Exposed portions of the photohardenable layer harden and become nonconductive, while the unexposed parts of the layer remain unhardened and conductive. When the master is electrostatically charged and developed by applying a toner of opposite charge, the toner adheres to exposed areas. Such films, however, are difficult to handle due to the tackiness of unhardened polymer.

Photoelectrographic master elements generally have a conductive layer in electrical contact with a film layer. When exposed to ultraviolet radiation, photochemically-generated charges form in the film, making the film conductive, while unexposed areas of the film remain insulating. When the element is charged, charges at the surface of the element and at the interface between the film and the conductive layers are neutralized where exposure has occurred. Unexposed areas, however, are charged and then developed with toner. The toned image is transferred to a receptor sheet. In U.S. Pat. No. 4,661,429 to Molaire et al., the film layer includes an aromatic onium salt or a 6-substituted-2,4-bis (trichloromethyl)-5-triazine acid photogenerator, an insulating binder, and, optionally, a sensitizer.

Photoelectrographic elements capable of exposure with near-infrared radiation (having wavelengths of 650 to 1000 nm) have also been developed. Such elements are particularly desirable because radiation in this part of the spectrum is emitted by laser diodes which are relatively inexpensive and consume little energy.

U.S. Pat. No. 3,909,254 to Tamai discloses a photoelectrographic master element, containing an organic photoconductor and a polymeric resin, which is exposed with a laser. The organic photoconductor of this element operates in a conventional fashion by normally being non-conductive and achieving conductivity when exposed.

U.S. Pat. No. 4,124,286 to Barasch discloses a xerographic printing process in which a first source of information is imaged on a photoconductive medium, capable of achieving persistent conductivity, to form a conductive representative image. The conductive image is transferred to another photoconductor on which a complimentary source of information is imaged with a laser.

U.S. Pat. No. 4,047,945 to Pfister relates to a xeroprinting master element consisting essentially of a conductive base member, a non-persistent photoconductive insulating layer, a persistent photoconductive insulating layer containing an acid sensitive charge transfer complex, and a dielectric layer. The process of utilizing the element comprises: charging, blanket exposing the non-persistent photoconductive insulating layer without activating the persistent photoconductive insulating layer, and developing after field collapse across the non-persistent photoconductive layer. When blanket exposed, the interface between the insulating layers provides a barrier to charge injection in non-imaged areas.

These elements, however, have not received widespread acceptance, because they employ a complicated construction and are utilized in a complex process.

SUMMARY OF THE INVENTION

The present invention relates to a photoelectrographic element for electrostatic imaging utilizing a photosensitive layer which forms a barrier to charge injection in portions of the layer exposed with near-infrared radiation but not in unexposed portions. This permits the formation of an electrostatic latent image on the element by applying a charge to the entire surface of the element.

This effect can be achieved with either positive or negative corona charging provided that the element has both a conductive layer capable of injecting an opposite charge and a photosensitive layer which can transport the charge to neutralize the corona charge absent exposure. When utilizing a negative corona charge, the work function energy of the conductive layer should be greater than the oxidation potential of the materials in the photosensitive layer. For positive charging, the reduction potential of the photosensitive layer components should be greater than the work function energy of the conductive layer materials. Once exposed, a barrier to further charge injection is created. As a result, the surface of the element can be repeatedly charged and toned to produce multiple copies from a single exposure. This is exactly opposite the effect achieved by prior art photoelectrographic processes. For example, in U.S. Pat. No. 4,661,429 to Molaire et al., the conductive and acid generating layers of the photoelectrographic element are formed from materials which cause unexposed areas to charge, while exposed areas remain uncharged.

The photosensitive layer of the present invention is free of photopolymerizable material and is in electrical contact with the conductive layer. The photosensitive layer contains an organic photoconductor and a near-infrared radiation sensitizer. Unless the photoconductor is polymeric, the photosensitive layer should also contain an organic binder.

Photoelectrographic elements in accordance with the present invention can be produced either to accept positive or negative corona charging. While not wishing to be bound by theory, it is believed that in this embodiment, near-infrared radiation exposure creates traps for either positive or negative charges in the photosensitive layer. The presence of such traps prevents charge injection and permits exposed portions of the element to undergo negative or positive charging.

The present invention also provides a photoelectrographic imaging method which utilizes the above-described photoelectrographic element. This process comprises the steps of: exposing the photosensitive layer imagewise to near-infrared radiation (having a wavelength of 650 to 1000 nm) without prior charging to create a latent conductivity pattern and printing by a sequence comprising: charging to create an electrostatic latent image, developing the electrostatic latent image with charged toner particles, transferring the toned image to a suitable receiver, and cleaning any residual, untransferred toner from the photoelectrographic element.

DETAILED DESCRIPTION OF THE DRAWINGS

Figure 1A:
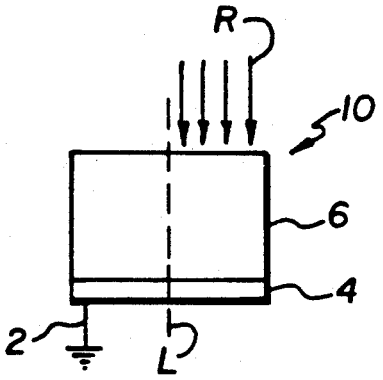
FIGS. 1A, 1B, 1C, and 1D show the photoelectrographic process sequence of the present invention.

As already noted, the present invention relates to a photoelectrographic element for electrostatic imaging having a conductive layer on a support layer and a photosensitive layer which is free from photopolymerizable materials and is in electrical contact with the conductive layer. The photosensitive layer contains an organic photoconductor, a near-infrared radiation sensitizer and, unless the organic photoconductor is polymeric, an organic binder. These materials are selected so that the photosensitive layer forms a barrier to charge injection after exposure with near-infrared radiation. As a result, exposed areas of the photoelectrographic element can be charged, while unexposed parts cannot.

Useful conducting layers include any of the electrically conducting layers and supports used in electrophotography. These include, for example, paper (at a relative humidity above about 20 percent); aluminum paper laminates; metal foils, such as aluminum foil, zinc foil, etc.; metal plates, such as aluminum, copper, gold, zinc, brass, nickel, indium, magnesium, alloys thereof, and galvanized plates; regenerated cellulose and cellulose derivatives; certain polyesters, especially polyesters having a thin electroconductive layer (e.g., cuprous iodide or indium tin oxide) coated thereon; etc.

While the photosensitive layers of the present invention can be affixed, if desired, directly to a conducting substrate or support, it may be desirable to use one or more intermediate subbing layers between the conducting layer or substrate and the photosensitive layer to improve adhesion.

Such subbing layers, if used, typically have a dry thickness in the range of about 0.1 to about 5 μm. Useful subbing layer materials include film-forming polymers such as cellulose nitrate, polyesters, copolymers or poly(vinyl pyrrolidone) and vinylacetate, and various vinylidene chloride-containing polymers including two, three, and four component polymers prepared from a polymerizable blend of monomers or prepolymers containing at least 60 percent by weight of vinylidene chloride. Other useful subbing materials include the so-called tergels which are described in U.S. Pat. No. 3,501,301 to Nadeau et al.

Optional overcoat layers are useful with the present invention, if desired. For example, to improve surface hardness and resistance to abrasion, the surface layer of the photoelectrographic element of the invention may be coated with one or more organic polymer coatings or inorganic coatings. A number of such coatings are well known in the art, and, accordingly, an extended discussion thereof is unnecessary. Several such overcoats are described, for example, in *Research Disclosure*, "Electrophotographic Elements, Materials, and Processes", Vol. 109, page 63, Paragraph V, May, 1973, which is incorporated herein by reference.

The organic photoconductor can be triarylamines diarylsulfones, alkylsulfones, and triarylmethanes. Particularly preferred organic photoconductors are 4,4',4''-trimethyl triphenylamine, bis-(4-diethylamino-2-methyl phenyl) phenylmethane, 1,1-bis-(4-diethylamino-2-methylphenyl)-2-methyl propane, diphenylsulfone, and tri-para-tolylamines.

The near-infrared radiation sensitizer may be any of the following:
1,3,3-trimethyl-2-[7-(1,3,3-trimethyl-5-nitroindolenin-2-yl)-4-chloro-3,5-trimethylene -1,3,5-heptatrienylidene]-5-nitroindolium hexafluorophosphate, and titanyl tetrafluorophthalocyanine. Such sensitizers are selected to absorb near-infrared radiation and to interact with other materials in the photosensitive layer to form charge traps.

Unless the organic photoconductor is a polymeric material, the photosensitive layer should also contain an organic binder. Suitable binder materials are polymers such as polycarbonates, polyesters, polyolefins, phenolic resins, and the like. Desirably, the binders are film forming. Such polymers should be capable of supporting an electric field in excess of $1\times10^5$ V/cm and exhibit a low dark decay of electrical charge.

Preferred binders are styrene-butadiene copolymers; silicone resins; styrene-alkyd resins; soya-alkyd resins; poly(vinyl chloride); poly(vinylidene chloride); vinylidene chloride; acrylonitrile copolymers; poly(vinyl acetate); vinyl acetate, vinyl chloride copolymers; poly(vinyl acetals), such as poly(vinyl butyral); polyacrylic and methacrylic esters, such as poly(methyl methacrylate), poly(n-butyl methacrylate), poly(isobutyl methacrylate), etc; polystyrene; nitrated polystyrene; poly(vinylphenol)polymethylstyrene: isobutylene polymers: polyesters, such as phenol formaldehyde resins; ketone resins; polyamides; polycarbonates; etc. Methods of making resins of this type have been described in the prior art, for example, styrene-alkyd resins can be prepared according to the method described in U.S. Pat. Nos. 2,361,019 and 2,258,423. Suitable resins of the type contemplated for use in the photoactive layers of this invention are sold under such tradenames as Vitel PE 101-X, Cymac, Piccopale 100, and Saran F-220. Other types of binders which can be used include such materials as paraffin, mineral waxes, etc. Particularly preferred binders are aromatic esters of polyvinyl alcohol polymers and copolymers, as disclosed in pending U.S. patent application Ser. No. 509,119, entitled "Photoelectrographic Elements". One example of such a polymer is poly (vinyl m-bromobenzoate-co-vinyl acetate).

Other particularly preferred materials are poly[(2,2-dimethyl-1,3-propylene-co-ethylene terephthalate)], poly [(4,4'-hexahydro-4,7-methanoldene-5-ylidene)-bisphenoxyethylene-co-ethylene terephthalate, bisphenol-A-polycarbonate, poly(oxycarbonyloxy-1,4-phenylene(methylidene)-1,4-phenylene), and mixtures thereof.

Where the photosensitive layer includes an organic binder, this layer contains 15% to 40% organic photoconductor, 0.2% to 5% near-infrared radiation sensitizer, and 55% to 85% organic binder. In the absence of an organic binder, the photosensitive layer includes 94% to 99.8% polymeric organic photoconductor and 0.2% to 6% near-infrared radiation sensitizer.

Typically, the conductive layer of the photoelectrographic element of the present invention is 0.1 to 2 μm, preferably 0.5 μm thick. The photosensitive layer has a layer thickness of 5 to 20 μm, preferably 10 μm.

In preparing photosensitive layers, the organic photoconductor, the near-infrared radiation sensitizer, and, if present, the organic binder are dissolved in a suitable solvent. Solvents of choice for preparing coatings include a number of solvents including aromatic hydrocarbons such as toluene; ketones, such as acetone or 2-butanone; esters, such as ethyl acetate or methyl acetate, chlorinated hydrocarbons such as ethylene dichloride, trichloroethane, and dichloromethane ("DCM"), ethers such as tetrahydrofuran; or mixtures of these solvents.

The photosensitive layers are coated on a conducting support in any well-known manner such as by doctor-blade coating, swirling, dip-coating, and the like.

The photoelectrographic elements of the present invention are employed in the photoelectrographic process, described below with reference to FIGS. 1A–1D. This process involves a 2-step sequence—i.e., an exposing phase followed by a printing phase.

In the exposing phase, shown in FIG. 1A, the portion of photosensitive layer 6 to the right of line L is exposed imagewise to near-infrared radiation R without prior charging to create a latent pattern in element 10. Element 10 is then ready to be subjected to the printing phase either immediately or after some period of time has passed.

Figure 1B:
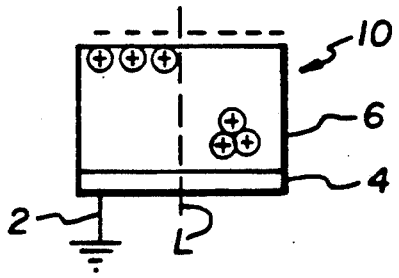

In the printing phase, element 10 is given a blanket electrostatic charge by placing it under a corona discharge (not shown). While not wishing to be bound by theory, it is believed that in exposed areas (i.e., to the right of line L) charges (i.e., positive charges in this embodiment) initially injected from conductive layer 4, attached to ground 2, are immediately trapped within photosensitive layer 6, as shown in FIG. 1B. The trapped charges block any further injection of charge. As a result, exposed portions of element 10 can be charged (negatively in this embodiment) at the surface of photosensitive layer 6, creating an electrostatic latent image. In unexposed portions of element 10 (i.e., to left of line L), positive charges (i.e., holes) travel from conductive layer 4 to the surface of photosensitive layer 6, neutralizing negative charges at this location.

Figure 1C:
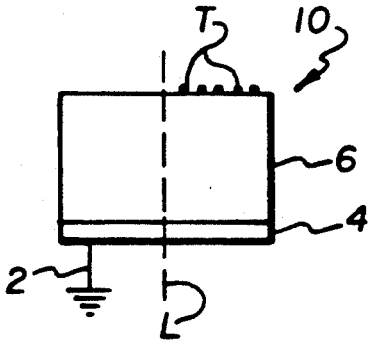
Figure 1D:
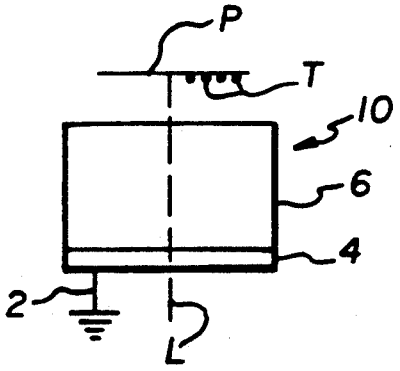

After charging, the electrostatic latent image is developed with charged toner particles T, as shown in FIG. 1C. In this case, exposed area development is utilized; however, it is instead also possible to develop charged areas. In either case, appropriate toners well known in the art can be utilized. The toned image is transferred to receiver P (e.g., paper), as shown in FIG. 1D. The toner particles can be fused either to a material (e.g., paper) on which prints are actually made or to an element to create an optical master or a transparency for overhead projection. Any residual, untransferred toner is then cleaned away so that the above-described printing phase can be repeated. By this process, multiple prints from a single exposure can be prepared by subjecting photoelectrographic element 10 only once to the exposing phase, as shown in FIG. 1A, and then subjecting element 10 to the printing phase once for each print made, as shown in FIGS. 1B to 1D.

The toner particles are in the form of a dust, a powder, a pigment in a resinous carrier, or a liquid developer in which the toner particles are carried in an electrically insulating liquid carrier. Methods of such development are widely known and described as, for example, in U.S. Pat. Nos. 2,296,691, 3,893,935, 4,076,857, and 4,546,060.

Developing can be carried out with a charged toner having the same polarity as the latent electrostatic image or with a charged toner having a polarity different from the latent electrostatic image. In one case, a positive image is formed. In the other case, a negative image is formed.

One type of photoelectrographic element in accordance with the present invention is charged negatively, as shown in FIG. 1B. However, other elements, also encompassed by this invention, may instead be charged positively.

To enable the photoelectrographic element of the present invention to be charged where exposed but not where unexposed, it is necessary to form the conductive layer and the photosensitive layer from materials which will permit charge injection and transport absent exposure and prevent such injection and transport after exposure. Generally, this is achieved by selecting conductive layer materials and photosensitive layer constituents which have favorable differences in energy levels absent exposure. For the conductive layer, this energy level is measured in terms of work function. As to the photosensitive layer, the oxidation/reduction potential of the organic photoconductor is utilized. Specifically, the oxidation potential is relevant for negative charging, while the reduction potential must be considered for positive charging. When utilizing a negative corona charge, the work function energy of the conductive layer constituents should be greater than the oxidation potential in the photosensitive layer. For positive charging, the reduction potential of the photosensitive layer components should be greater than the work function energy of the conductive layer materials. Once exposed, a barrier to further charge injection is created. Such work function and oxidation/reduction potential values are available from a variety of sources, including U.S. Pat. Nos. 4,885,211 to Tang et al. and 4,514,481 to Scozzafava et al.

For example, an indium conductive layer has a work function of +5.5 to 6.0 electron volts, while a photosensitive layer with a tri-para-tolyl amine organic photoconductor has an oxidation potential of +.81 volts. This oxidation potential can be converted from the electrochemical scale to the vacuum scale by adding 4.5 to the +.81 volt value. Thus, the indium conductive layer has a work function (i.e. +5.5 to 6.0 electron volts) greater than the oxidation potential of the tri-para-tolylamine organic photoconductor (i.e. +5.31 electron volts). As a result, a photoelectrographic element formed with such layers can achieve charge injection. Further, selection of an appropriate near-infrared radiation sensitizer permits the element to be exposed and negatively charged, as shown in FIGS. 1A to 1D.

For positive charging, a magnesium-aluminum alloy (in a 10:1 magnesium to aluminum ratio), having a work function of +3.5 to 4.0 electron volts, can be utilized as the conductive layer and an organic photoconductor of diphenylsulfone, having a reduction potential of −0.13 volts, can be employed. Converting the latter value to the vacuum scale yields a reduction potential of +4.37 electron volts. Since this reduction potential is greater than the work function value of the conductive layer, a photoelectrographic element with such layers can be exposed and positively charged in accordance with the present invention.

The following examples are provided to illustrate the usefulness of the photoelectrographic element of the present invention and are by no means intended to exclude the use of other elements which fall within this disclosure.

EXAMPLES

Example 1

A CuI containing conductive layer, solvent coated at 39 mg/ft$^2$ on a polyester support, was machine coated with the following composition to achieve a coverage of 0.85/ft$^2$:

| | |
|---|---|
| Poly[(4,4'-hexahydro-4,7-methanoldene-5-ylidene)-bisphenoxyethylene-co-ethylene terephthalate] | 92.22 g |
| Bisphenol-A-polycarbonate | 16.28 g |
| 4,4',4''-trimethyl triphenylamine | 46.5 g |
| 1,3,3-trimethyl-2-[7-(1,3,3-trimethyl-5-nitroindolenin-2-yl)-4-chloro-3,5-trimethylene-1,3,5-heptatrienylidene]-5-nitroindolium hexafluorophosphate | 3.1 g |
| Polymethylphenylsiloxane having a 23:1 methyl to phenyl ratio | 3.0 g of a 10% solution in DCM |

A sample of this film was evaluated for sensitivity to near-infrared radiation using a breadboard equipped with a 200 mw near-infrared laser diode (827 nm) with the output beam focused to about a 30 micron spot. The breadboard consisted of a rotating drum, upon which the film was mounted and a translation stage which moved the laser beam along the drum length. The drum rotation, the laser-beam location, and the laser beam power were all controlled by computer. The drum was rotated at a speed of 120 RPM, and the film was exposed to an electronically-generating continuous tone stepwedge. The line spacing (distance between scan lines) was 25 microns, and the maximum laser power was about 100 mw with an exposure time of about 96 microseconds per pixel. After exposure, the sample was mounted on an electrophotographic linear breadboard. The sample was corona charged with a grid-controlled charger set at a grid potential of ±500 volts. The resulting surface potential was then measured at 1 sec, 15 sec, and 45 seconds after charging.

For positive charging, this surface potential was found to be persistent and lasted for many hours. The maximum contrast (i.e., the largest potential difference between exposed and unexposed areas) occurred, not at the maximum exposure, but at an intermediate exposure level. In one example, the maximum contrast for 1 second after charging was about 270 volts.

When negative corona charging the element of Example 1, the maximum delta V was only about 50 volts, which is not adequate for xeroprinting images.

When the drums were rotated at 600 RPM rather the 120 RPM above, the maximum contrast potential was about 250 volts 1 second after charging. The memory retention was checked by recharging this master each day and measuring the surface potential resulting from the initial exposure. It was found that the surface potential lasted for more than a week. This sample was additionally exposed at 600 RPM to a video image of a house scene. After charging, the master was developed with cyan toner, and the image was transferred to paper and fused.

Example 2

Using the process of Example 1, a film was formed to achieve a coverage of 0.85g/ft$^2$ with the following composition:

| | |
|---|---|
| Poly[(4,4'-hexahydro-4,7-methanoldene-5-ylidene)-bisphenoxyethylene-co-ethylene terephthalate] | 79.05 g |
| Bisphenol-A-polycarbonate | 13.95 g |
| 4,4',4''-trimethyl triphenylamine | 31.00 g |
| Bis(4-diethylamino-2-methylphenyl) phenylmethane | 31.00 g |
| 1,3,3-trimethyl-2-[7-(1,3,3-trimethyl-5-nitroindolenin-2-yl)-4-chloro-3,5-trimethylene-1,3,5-heptatrienylidene]-5-nitroindolium hexafluorophosphate | 3.1 g |
| Polymethylphenylsiloxane having a 23:1 methyl to phenyl ratio | 3.0 g of a 10% solution in DCM |

A sample of this film was tested in the manner described in Example 1. In this formulation, the maximum contrast 1 second after charging was only about 160 volts as compared to about 270 volts in Example 1. However, the maximum contrast was higher than in Example 1 for the 15 and 45 second data. This indicates that, for positive charging, this film may be better suited for use in a low-volume application where the time between charge and development can be many seconds.

Another significant difference between Examples 1 and 2 is in the electrical response for negative charging. In Example 1, the maximum contrast was less than 50 volts, while Example 2 achieved a maximum contrast of about 300 volts, 1 second after charging. This means that, for negative charging, the film of Example 2 could be used in high-volume applications.

Example 3

Using the process of Example 1, a film was formed to achieve a coverage of 0.95 g/ft$^2$ with the following composition:

| | |
|---|---|
| Poly[(4,4'-hexahydro-4,7-methanoldene-5-ylidene)-bisphenoxyethylene-co-ethylene | 158.1 g |

-continued

| | |
|---|---|
| terephthalate] | |
| Bisphenol-A-polycarbonate | 27.8 g |
| Bis(4-diethylamino-2-methylphenyl) phenylmethane | 38.0 g |
| Bis(4-diethylamino-2-methylphenyl)-4-tolylemethane | 38.0 g |
| 1,1-bis(4-diethylamino-2-methylphenyl)-2-methylpropane | 38.0 g |
| 1,3,3-trimethyl-2-[7-(1,3,3-trimethyl-5-nitroindolenin-2-yl)-4-chloro-3,5-trimethylene-1,3,5-heptatrienylidene]-5-nitroindolium hexafluorophosphate | 2.1 g |
| p-toluene sulphonic acid | 0.6 g |
| Polymethylphenylsiloxane having a 23:1 methyl to phenyl ratio | 2.0 g of a 10% solution in DCM |
| Bisphenol A-block-poly(dimethyl-siloxane) adipate | 3.0 g of a 10% solution in DCM |

A sample of this film was tested in a manner identical to that described in Example 1. As in the previous examples, the maximum contrast potential depended on the charging polarity and the time after charging.

Example 4

This coating comprised a 1.0 g/ftdry coverage of the following compounds on a CuI containing conductive layer which in turn was solvent coated at a 30 mg/ft$^2$ coverage on a polyester support:

| | |
|---|---|
| Poly(oxycarbonyloxy-1,4-phenylene(-1-methylidene)-1,4-phenylene) | 7.2 g |
| Bis(4-diethylamino-2-methylphenyl) phenylmethane | 4.8 g |
| 1,3,3-trimethyl-2-[7-(1,3,3-trimethyl-5-nitroindolenin-2-yl)-4-chloro-3,5-trimethylene-1,3,5-heptatrienylidene]-5-nitroindolium hexafluorophosphate | 0.24 g |

A sample of this film was tested in a manner identical to that described in Example 1. For this formulation, negative corona charging gave excellent results, while positive corona charging achieved very little effect.

Example 5

The following compounds were hand coated on a conductive support like that described in Example 1:

| | |
|---|---|
| Poly[(4,4'-hexahydro-4,7-methanoldene-5-ylidene)-bisphenoxyethylene-co-ethylene terephthalate] | 2.55 g |
| Bisphenol-A-polycarbonate | 0.45 g |
| Titanyl tetrafluorophthalocyanine | 0.8 g |
| Polymethylphenylsiloxane having a 23:1 methyl to phenyl ratio | 2 drops of a 10% solution in DCM |
| DCM | 16.8 g |
| 1,1,2-trichloroethane | 4.2 g |

In this example, the titanyl tetrafluorophthalocyanine pigment was dispersed by milling in zirconium bead media for four hours. A coating was made with a 0.005" wet thickness coating blade, resulting in a layer thickness of about 10 microns.

A sample of this film was tested as in Example 1. For this formulation, positive corona charging gave good results while the results, for negative charging were poor.

Although the invention has been described in detail for the purpose of illustration, it is understood that such detail is solely for that purpose, and variations can be made therein by those skilled in the art without departing from the spirit and scope of the invention which is defined by the following claims.

What is claimed is:

1. A photoelectrographic element for electrostatic imaging comprising:
   a conductive layer and
   a photosensitive layer, which is free of photopolymerizable materials and is in electrical contact with said conductive layer, comprising:
   an organic photoconductor and
   a near-infrared radiation sensitizer selected from the group consisting of 1,3,3-trimethyl-2-[7-(1,3,3-trimethyl-5-nitroindolenin-2-yl)-4-chloro-3,5-trimethylene-1,3,5-heptatrienylidene]-5-nitroindolium hexafluorophosphate, and titanyl tetrafluorophthalocyanine, wherein said conductive layer and said photosensitive layers are selected so that said photosensitive layer forms a barrier to charge injection in portions of said photosensitive layer exposed with near-infrared radiation but not in unexposed portions thereof, whereby exposed portions of said photoelectrographic element then can be charged, while unexposed portions of said photoelectrographic element cannot be charged to form an electrostatic latent image on said element.

2. A photoelectrographic element according to claim 1, wherein the organic photoconductor is selected from the group consisting of triarylamines, diarylsulfones, alkylsulfones, and triarylmethanes.

3. A photoelectrographic element according to claim 2, wherein the organic photoconductor is a triarylamine selected from the group consisting of 4,4',4''-trimethyl triphenylamine, bis-(4-diethylamino-2-methylphenyl) phenylmethane, 1,1-bis-(4-diethylamino-2-methylphenyl)-2-methylpropane, diphenyl sulfone, and tri-para-tolylamines.

4. A photoelectrographic element according to claim 1, wherein said photosensitive layer further comprises: an organic binder.

5. A photoelectrographic element according to claim 4, wherein the organic binder is selected from the group consisting of polycarbonates, polyesters, polyolefins, phenolic resins, paraffins, mineral waxes, and mixtures thereof.

6. A photoelectrographic element according to claim 5, wherein the organic binder is selected from the group consisting of poly[(2,2-dimethyl-1,3-propylene)-co-(ethylene terephthalate)], poly [(4,4'-hexahydro-4,7-methanoldene-5-ylidene)bisphenoxyethylene-co-ethylene terephthalate, poly (vinyl m-bromobenzoate)-co-vinylacetate, bisphenol-A-polycarbonate, poly(oxycarbonyloxy-1,4-phenylene (methylidene) -1,4-phenylene, and mixtures thereof.

7. A photoelectrographic element according to claim 1, wherein the conductive layer comprises a cuprous iodide layer coated on a polymeric substrate.

8. A photoelectrographic element according to claim 1, wherein said conductive layer is formulated to have a work function energy greater than said photosensitive layer oxidation potential, whereby said photoelectrographic element can be negatively charged.

9. A photoelectrographic element according to claim 1, wherein said photosensitive layer is formulated to have a reduction potential which is greater than or equal to the conductive layer work function energy, whereby said photoelectrographic element can be positively charged.

10. A photoelectrographic method for printing using a photoelectrographic element comprising:

a conductive layer and a photosensitive layer, which is free of photopolymerizable materials and is in electrical contact with said conductive layer, comprising:

an organic photoconductor and a near-infrared radiation sensitizer selected from the group consisting of 1,3,3-trimethyl-2-[7-(1,3,3-trimethyl-5-nitroindolenin-2-yl)-4-chloro,3,5-trimethylene-1,3,5-heptatrienylidene]-5-nitroindolium hexafluorophosphate, and titanyl tetrafluorophthalocyanine, wherein said method comprises:

exposing said element to near-infrared radiation without prior charging to create a barrier to charge injection in exposed portions of said photosensitive layer but not in unexposed portions thereof, and printing an image from said exposed element, said printing comprising:

charging said element, whereby exposed portions of said element are charged, while unexposed portions are not charged to form an electrostatic latent image on said element;

developing the electrostatic latent image by applying charged toner particles to said element to produce a toned image; and transferring the toned image to a suitable received, wherein said printing is carried out one time for each print made.

11. A method according to claim 10, wherein the organic photoconductor is selected from the group consisting of triarylamines, diarylsulfones, alkylsulfones, and triarylmethanes.

12. A method according to claim 10, wherein said photosensitive layer further comprises:

an organic binder selected from the group consisting of polycarbonates, polyesters, polyolefins, phenolic resins, paraffins, mineral waxes, and mixtures thereof.

13. A method according to claim 10, wherein the conductive layer comprises a cuprous iodide layer coated on a polymeric substrate.

14. A method according to claim 10 further comprising:

cleaning any residual toner particles not transferred to the receiver from said element for each print made.

15. A method according to claim 10, wherein the receiver is a substrate for permanently receiving a toned image as a print.

16. A method according to claim 10, wherein said charging is with a charge of positive polarity.

17. A method according to claim 10, wherein said charging is with a charge of negative polarity.

18. A photoelectrographic element for electrostatic imaging comprising:

a conductive cuprous iodide layer and a photosensitive layer, which is free of photopolymerizable material and is in electrical contact with said conductive cuprous iodide layer, comprising:

an organic photoconductor selected from the group consisting of triarylamines, diarylsulfones, alkylsulfones, and triarylmethanes;

an organic binder selected from the group consisting of polycarbonates, polyesters, polyolefins, phenolic resins, paraffins, mineral waxes, and mixtures thereof; and a near-infrared radiation sensitizer selected from the group consisting of 1,3,3-trimethyl-2-[7-(1,3,3-trimethyl-5-nitroindolenin-2-yl)-4-chloro-3,5-trimethylene-1,35-heptatrienylidene]-5-nitroindolium hexafluorophosphate, and titanyl tetrafluorophthalocyanine, wherein said conductive layer and said photosensitive layer is selected so that said photosensitive layer forms a barrier to charge injection in portions of said photosensitive layer exposed with near-infrared radiation but not in unexposed portions thereof, whereby exposed portions of said photoelectrographic element then can be negatively charged, while unexposed portions of said photoelectrographic element cannot be charged to form an electrostatic latent image on said element.

* * * * *